US006179160B1

(12) United States Patent
Alli

(10) Patent No.: US 6,179,160 B1
(45) Date of Patent: Jan. 30, 2001

(54) SQUIRREL CAGE-TYPE ARTICLE DISPENSER

(75) Inventor: Safdar Alli, Markham (CA)

(73) Assignee: Opal Manufacturing Ltd., Toronto (CA)

( * ) Notice: Under 35 U.S.C. 154(b), the term of this patent shall be extended for 0 days.

(21) Appl. No.: 09/397,129

(22) Filed: Sep. 16, 1999

(51) Int. Cl.[7] ..... G07F 11/00
(52) U.S. Cl. ..... 221/82; 221/277
(58) Field of Search ..... 221/2, 7, 15, 258, 221/277, 241, 69, 76, 82, 83, 242, 197

(56) References Cited

U.S. PATENT DOCUMENTS 3,791,553 * 2/1974 Aidlin et al. ..... 221/241
5,709,266 * 1/1998 Kruse ..... 221/277

* cited by examiner

*Primary Examiner*—Kenneth W. Noland
(74) *Attorney, Agent, or Firm*—H. Jay Spiegel

(57) ABSTRACT

A squirrel cage-type article dispenser includes a tube having an upwardly open slot. The slot leads to an angled ramp within the tube leading to a semi-cylindrical dispensing chamber. A pivotable flap adjacent the ramp deters tampering. A ring-like plate has a circular periphery and a central opening slidable over the tube. A rotary squirrel cage includes an outer cylindrical wall to which the circular periphery of the plate may be releasably attached, and a plurality of radially inwardly extending ribs have respective inner extents configured such that the inner edges of the ribs slidably engage the outer surface of the tube when the squirrel cage is assembled thereover. Adjacent ribs define, with the inner surface of the cylindrical wall and the outer surface of the tube, individual sub-chambers sized and configured to store articles to be dispensed. A drive motor coupled to the squirrel cage is designed to index the squirrel cage in a manner such that each indexing step aligns a successive sub-chamber with the open slot in the tube. A check control mechanism is operatively connected to the drive motor.

15 Claims, 5 Drawing Sheets

SQUIRREL CAGE-TYPE ARTICLE DISPENSER

BACKGROUND OF THE INVENTION

The present invention relates to a squirrel cage-type article dispenser. In the prior art, article dispensers are well known of various types, sizes and shapes. Article dispensers are employed to dispense a variety of diverse articles. Applicant is unaware of any such article dispenser having all of the features and aspects of the present invention.

SUMMARY OF THE INVENTION

The present invention relates to a squirrel cage-type article dispenser. The present invention is intended to be used to individually dispense pre-packaged cellular telephones or any other product of equivalent size. The present invention includes the following interrelated objects, aspects and features:

1. In a first aspect, the present invention contemplates a fixed housing including a tube having an upwardly open slot defined by parallel spaced edges. The slot leads to an angled ramp that conveys products to a semi-cylindrical chamber in the tube.

2. A rotary squirrel cage includes an outer cylindrical wall and a plurality of radially inwardly extending rectangular ribs that have respective inner extents configured such that the inner edges of the ribs slidably engage the outer surface of the tube when the squirrel cage is assembled thereover. Adjacent ribs define, with the inner surface of the cylindrical wall and the outer surface of the tube, individual sub-chambers sized and configured to store articles to be dispensed. The spacing between the inner edges of adjacent ribs corresponds to the width of the open slot in the tube. A rear cover completely overlies rear portions of the tube and squirrel cage, and a removable cover overlies front portions of the squirrel cage.

3. A drive shaft is connected to the squirrel cage at one end and to a drive motor at the other end. The drive motor is designed to index the squirrel cage in a manner such that each indexing step aligns a successive sub-chamber with the open slot in the tube.

4. A check control mechanism is operatively connected to the drive motor so that upon receipt of the required amount of money, the motor is activated to index the squirrel cage such that the next successive sub-chamber is aligned with the open slot in the tube so that a product contained within that sub-chamber will drop through the open slot and into the inner chamber of the tube, whereupon the product can be removed therefrom by the purchaser.

Accordingly, it is a first object of the present invention to provide a squirrel cage-type article dispenser.

It is a further object of the present invention to provide such a device having a tube with an upwardly open slot that aligns with sub-chambers in a rotary squirrel cage to dispense articles.

It is a still further object of the present invention to provide such a device wherein the squirrel cage is coupled to a rotary indexing motor.

It is a further object of the present invention to provide such a device wherein a check control mechanism controls operation of the motor.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
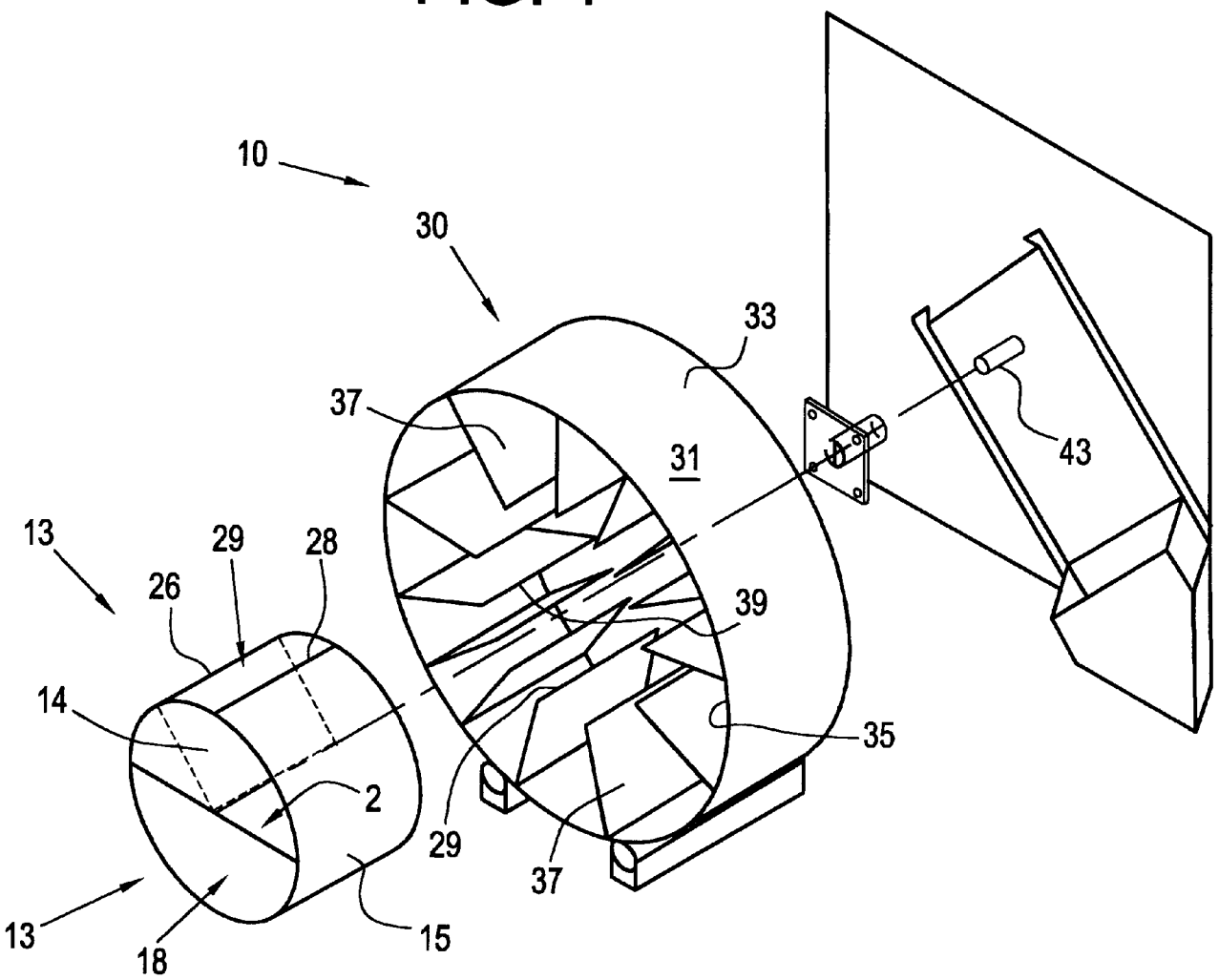
FIG. 1 shows an exploded perspective view of the present invention.
Figure 6:
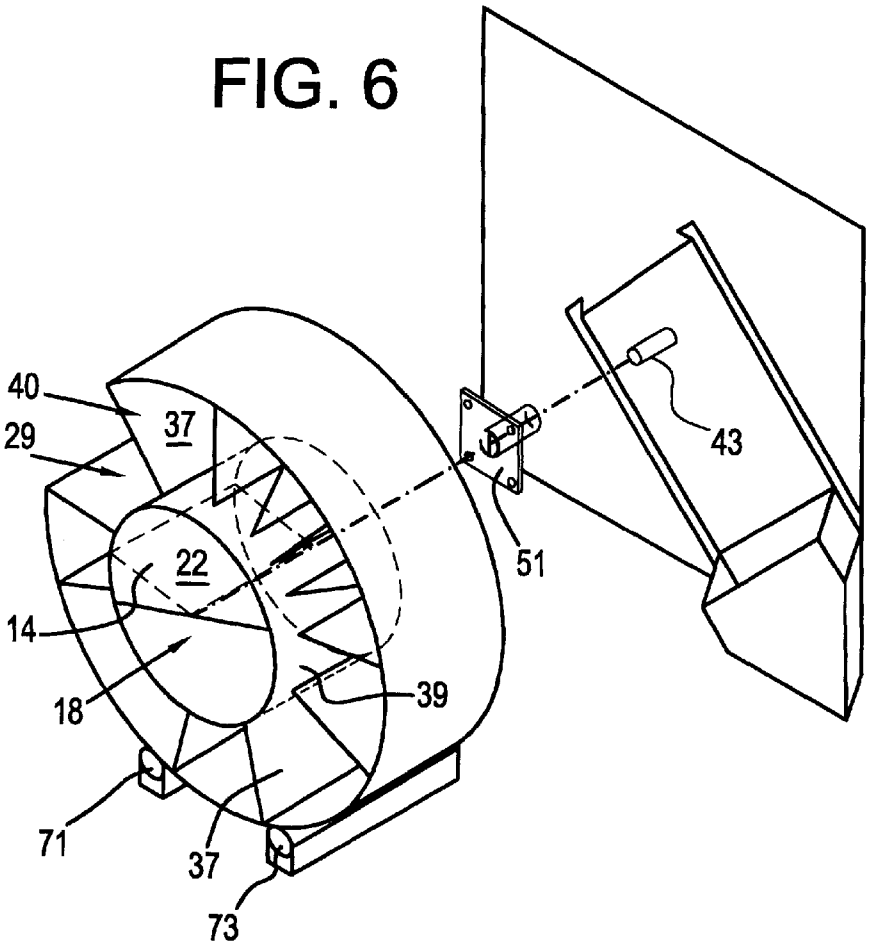
FIG. 6 shows a view from the same perspective as that of FIG. 1 but with the tube and squirrel cage assembled together.

With reference, first, to FIGS. 1 and 6, the present invention is generally designated by the reference numeral 10 and is seen to include a tube 13 and a rotary squirrel cage 30.

The tube 13 has an outer surface 15 and an inner surface 17.

Figure 4:
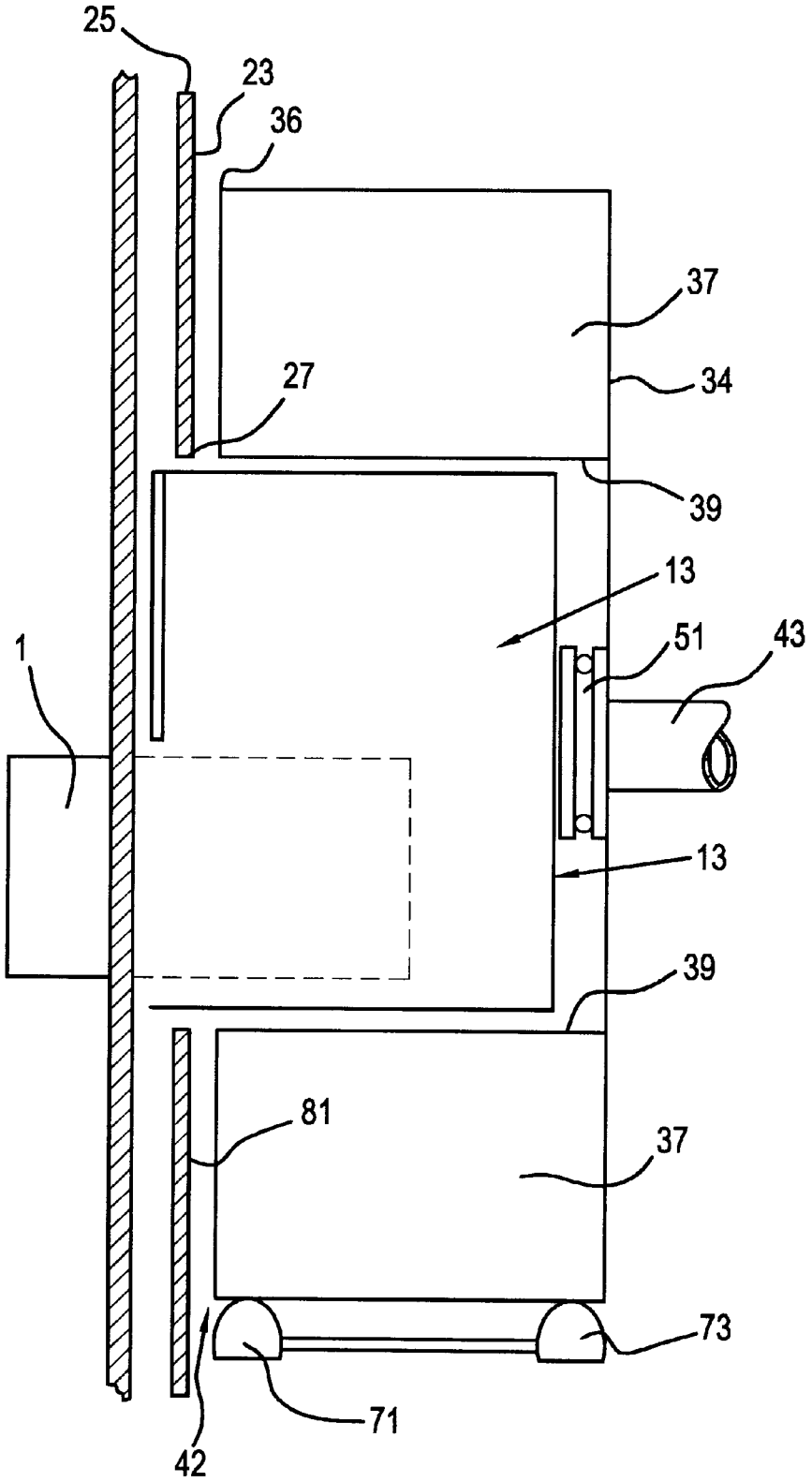
FIG. 4 shows a cross-section through the assembled dispenser.

The tube 13 has an end 19 that along with the end 32 of the squirrel cage 30 are closed by a plate 34 (FIG. 4). A removable ring plate 23 (FIG. 4), preferably made of PLEXIGLAS® material, overlies a front 42 of the squirrel cage 30 and has a circular outer edge 25 and a circular inner edge 27 for a purpose to be described in greater detail hereinafter.

Figure 2:
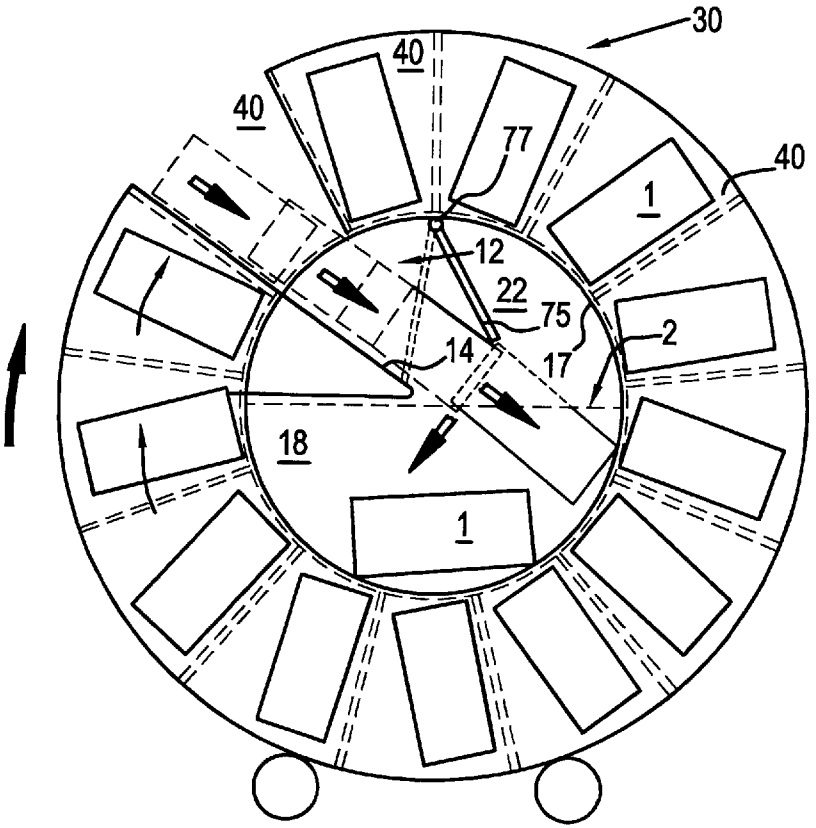
FIG. 2 shows an end view of the present invention.

With reference to FIGS. 1, 2 and 6, the tube 13 has a slot 29 that is defined by the spaced parallel edges 26 and 28 that have a desired spacing for a purpose to be described in greater detail hereinafter. The tube has a chute 12 (FIG. 2) defined by angled ramp surface 14 and the inner wall 17 that leads product through opening 2 to a semi-cylindrical dispensing chamber 18. A flap 75 is pivotably mounted within the sub-chamber 22 about a pivot 77. The flap 75 allows product traveling down the ramp surface 14 to travel therepast, but the flap prevents anyone from tampering with the device 10 by attempting to reach up the ramp surface 14 to steal product.

With further reference to FIGS. 1 and 6, the squirrel cage 30 includes an outer cylindrical wall 31 having an outer surface 33 and an inner surface 35. A plurality of rectangular ribs 37 extend radially inwardly from the inner surface 35 of the cylindrical wall 31. Each rib 37 has an inner edge 39 with the inner edges 39 together forming a generally circular or cylindrical configuration and slidably engaging the outer surface 15 of the tube 13 when the squirrel cage 30 is assembled over the housing 11.

The inner edges 39 are aligned with the inner edge 27 of the plate 23 (FIG. 4) to seal the sub-chambers 40 from the front of the squirrel cage 30. Also, when the squirrel cage 30 is assembled over the tube 13, the inner wall 81 of the plate 23, when assembled thereto, overlies the side edge 36 of the cylindrical wall 31 (FIG. 4), thereby closing what would otherwise be a lateral opening therein. When the squirrel cage 30 is assembled over the tube 13, the tube 13 enters the space within the radially inwardly located edges 39 of the ribs 37, thereby creating a plurality of sub-chambers 40 defined by respective adjacent ribs 37, the outer surface 15 of the tube 13, the inner surface 35 of the wall 31, the plate 23 and the rear wall 60 of the squirrel cage 30.

Figure 5:
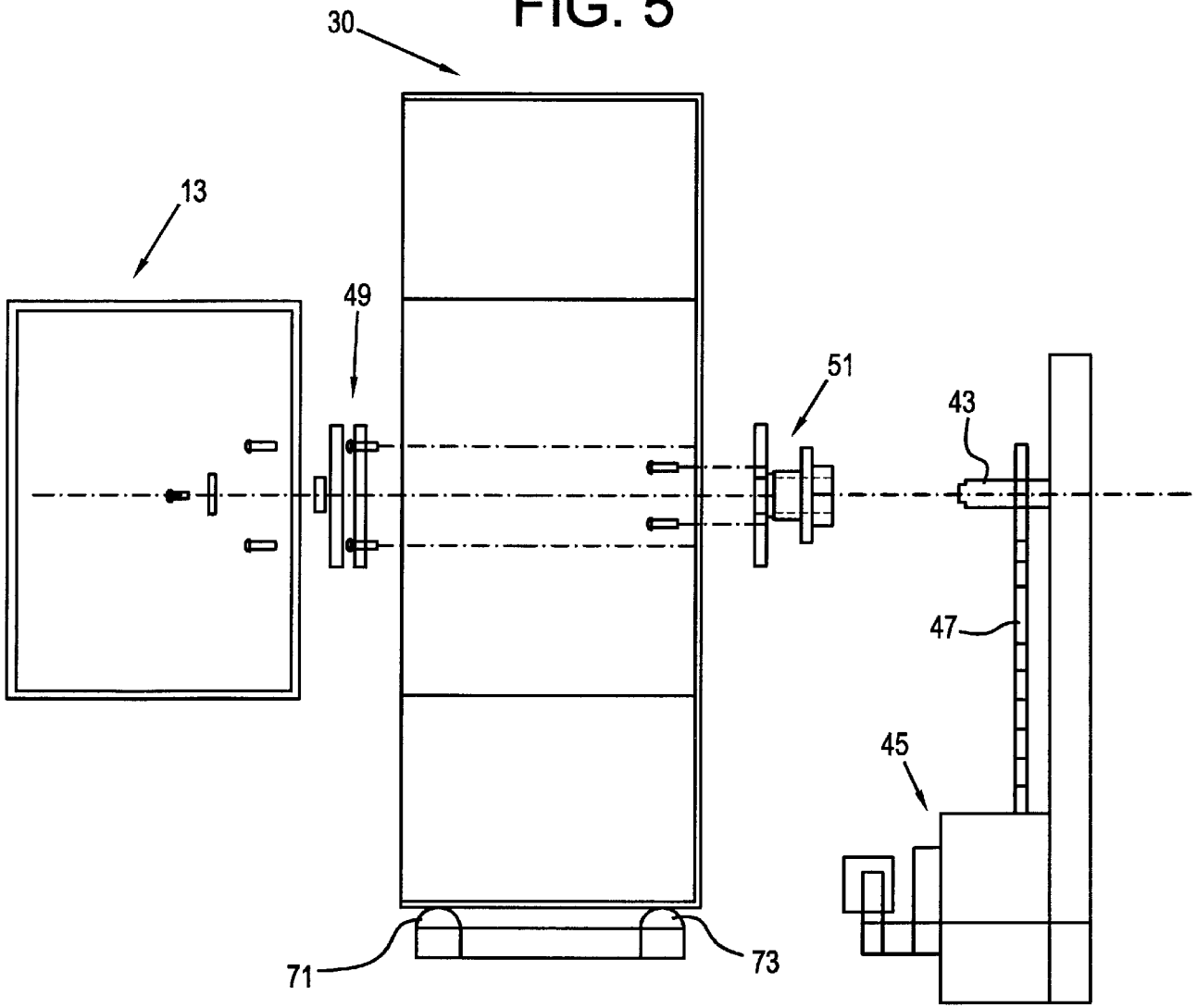
FIG. 5 shows an exploded side view thereof.

A drive shaft schematically shown in FIGS. 1 and 5 and designated by the reference numeral 43 is coupled to the squirrel cage 30 in any suitable manner as is understood by those skilled in the art such as, for example, with the coupling halves 49 and 51 (FIGS. 1 and 5). Also shown in FIG. 5 is a motor 45, preferably a stepper motor, having a drive shaft (not shown) coupled to the shaft 43 via a chain or belt 47. Support rollers 71 and 73 support the squirrel cage 30 for rotation within a product dispenser, the details of which are not shown in detail.

Figure 7:
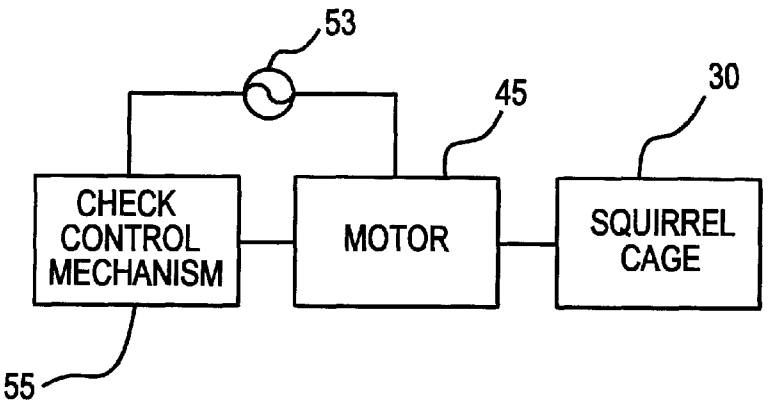
FIG. 7 shows a schematic representation of the electrical circuitry of the present invention.

With reference to FIG. 7, it is seen that a source of power 53 is coupled to the motor 45 via a check control means or mechanism 55 which, as is well known to those skilled in the article dispensing art, consists of a mechanism designed to receive money in various denominations and, when the correct amount of money for a purchase has been received, activates the motor 45 so that the motor can index the squirrel cage 30 to the next desired position.

Figure 3:
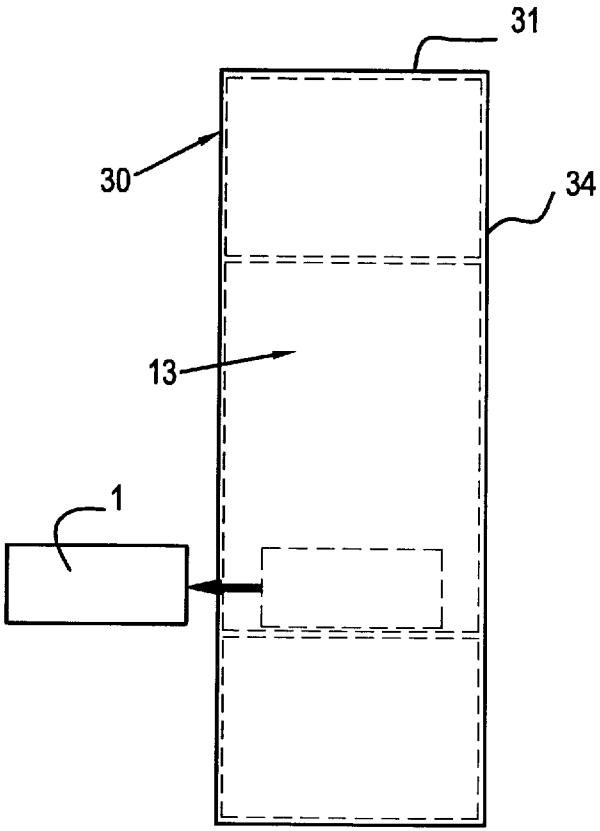
FIG. 3 shows a side view of the present invention.

As seen in FIGS. 2 and 3, when the squirrel cage 30 has indexed to the next desired position so that an article 1 is at the "10:30" position, drawing an analogy with a clock face, with the sub-chamber 40 thereof aligned with the slot 29 in the housing 11, the product 1 will drop angularly downwardly through the force of gravity into the sub-chamber 22 within the tube 13, pass through the opening 2 and enter the dispensing chamber 18, whereupon the user can reach into the dispensing chamber 18 and remove the product therefrom. As shown in FIG. 2, the product 3 slides down the ramp 14, hits the inner wall 17 of the tube 13 and then flips over to rest in the sub-chamber 18. When the next customer provides the desired amount of money to the check control mechanism 55 (FIG. 7), the motor 45 is activated to index the squirrel cage 30 to the next position in which a sub-chamber 40 is aligned at the "10:30" position over the fixed slot 29 in the tube 13, whereupon the next product 1 can be suitably dispensed.

The inventive squirrel cage-type article dispenser 10 may be suitably installed in any article dispenser of which many different types are known. The compact nature of the squirrel cage 30 allows easy installation in article dispensers that are quite compact in nature.

The housing 11 and squirrel cage 30 may be made of any suitable materials such as, for example, metal or plastic. The motor 45 may operate through batteries, through 110 Volt or 220 Volt alternating current or through connection to any desired appropriate source of electrical power.

The check control mechanism may be of any desired type or kind.

As such, an invention has been disclosed in terms of a preferred embodiment thereof which fulfills each and every one of the objects of the invention as set forth hereinabove and provides a new and useful squirrel cage-type article dispenser of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. An improved article dispenser, comprising:

a) a fixed housing including a cylindrical tube having an outer surface and a slot at an upper location thereon, said slot defined by spaced edges and leading to a dispensing chamber within said tube;

b) a rotatable squirrel cage mounted on said housing and including an outer wall to which are attached a multiplicity of spaced radially inwardly extending ribs;

c) each of said ribs having inner edges slidably engageable with said outer surface of said tube, adjacent pairs of ribs together with said outer surface of said tube and an inner surface of said outer wall defining a sub-chamber adapted to receive an article to be dispensed into said tube;

d) a drive motor coupled to said squirrel cage, whereby said squirrel cage may be rotated to index successive sub-chambers in alignment with said slot so that an article may fall through said slot and enter said dispensing chamber.

2. The dispenser of claim 1, wherein said spaced edges are spaced apart a distance substantially equal to a spacing between inner edges of adjacent ribs.

3. The dispenser of claim 1, wherein said outer wall of said squirrel cage is cylindrical.

4. The dispenser of claim 3, further including a ring-like plate with a circular outer periphery alignable with said outer wall, said plate being removably attachable to said squirrel cage and surrounding said tube.

5. The dispenser of claim 1, wherein said inner edges of said ribs define, together, portions of a cylinder.

6. The dispenser of claim 1, wherein each rib is generally rectangular.

7. The dispenser of claim 1, wherein said drive motor is a stepper motor.

8. The dispenser of claim 1, further including check control means for controlling operation of said motor.

9. The dispenser of claim 1, further including a ramp in said tube interposed between said slot and said dispensing chamber.

10. The dispenser of claim 9, further including a tamper resistant flap pivotably mounted in said tube adjacent said ramp.

11. The dispenser of claim 9, wherein said dispensing chamber is semi-cylindrical.

12. An improved article dispenser, comprising:

a) a fixed housing including a cylindrical tube having an outer surface and a rectangular slot at an upper location thereon, said slot defined by spaced parallel linear edges and leading to an angled ramp within said tube leading to a semi-cylindrical dispensing chamber;

b) a rotatable squirrel cage mounted on said housing and including an outer wall to which are attached a multiplicity of spaced radially inwardly extending rectangular ribs;

c) each of said ribs having inner edges slidably engageable with said outer surface of said tube, adjacent pairs of ribs together with said outer surface of said tube and an inner surface of said outer wall defining a sub-chamber adapted to receive an article to be dispensed;

d) a plate removably attachable to said squirrel cage and overlying front portions of each sub-chamber;

e) a stepper drive motor coupled to said squirrel cage whereby said squirrel cage may be rotated to index successive sub-chambers in alignment with said slot.

13. The dispenser of claim 12, wherein said spaced edges are spaced apart a distance substantially equal to a spacing between inner edges of adjacent ribs.

14. The dispenser of claim 12, further including check control means for controlling operation of said motor.

15. The dispenser of claim 12, further including a tamper resistant flap pivotably mounted in said tube adjacent said ramp.

* * * * *